US005183260A

United States Patent [19]

Kheir

[11] Patent Number: 5,183,260

[45] Date of Patent: Feb. 2, 1993

[54] TENNIS RACKET

[76] Inventor: Elie B. Kheir, 2825 Downing Cir., Birmingham, Ala. 35242

[21] Appl. No.: 828,511

[22] Filed: Jan. 31, 1992

[51] Int. Cl.[5] ..... A63B 49/08
[52] U.S. Cl. ..... 273/73 J
[58] Field of Search ..... 273/73 R, 73 H, 73 J, 273/73 K, 75, 81 R, 81 D, 81.2, 67 R, 67 DA

[56] References Cited

U.S. PATENT DOCUMENTS

| | | | |
|---|---|---|---|
| 760,161 | 5/1904 | Smith . | |
| 2,795,426 | 6/1957 | Wood | 273/73 R |
| 2,938,728 | 5/1960 | Green | 273/165 |
| 3,545,755 | 12/1970 | Owada | 273/73 J |
| 4,221,383 | 9/1980 | Cappelli | 273/73 R X |
| 4,720,106 | 1/1988 | Bickham | 273/73 R |
| 4,721,305 | 1/1988 | Cudlip | 273/73 J |
| 4,861,030 | 8/1989 | Burt | 273/73 J |
| 4,978,123 | 12/1990 | Ashihara | 273/73 J X |

FOREIGN PATENT DOCUMENTS

| | | | |
|---|---|---|---|
| 2750217 | 5/1979 | Fed. Rep. of Germany | 273/75 |
| 1246701 | 10/1960 | France | 273/73 J |
| 1380392 | 10/1964 | France | 273/73 J |
| 1473356 | 3/1967 | France | 273/73 J |
| 2528319 | 12/1983 | France | 273/73 J |
| 2626482 | 8/1989 | France | 273/73 J |

*Primary Examiner*—V. Millin
*Assistant Examiner*—William E. Stoll
*Attorney, Agent, or Firm*—Hopkins & Thomas

[57] ABSTRACT

A tennis racket (10) having two handles (15 and 16) angled from the racket head (11) an angle from ten to forty degrees. The handles 15, 16) have sides (29) that are parallel with the head of the tennis racket. The handles are mounted to the throat of the tennis racket parallel to one another and are rigidly secured by a strut member (19). The angle between the grips and the head of the tennis racket allows the tennis player to grip the tennis racket with two hands in a comfortable manner and allows the tennis player to hit the tennis ball out in front of his body.

5 Claims, 2 Drawing Sheets

FIG 1
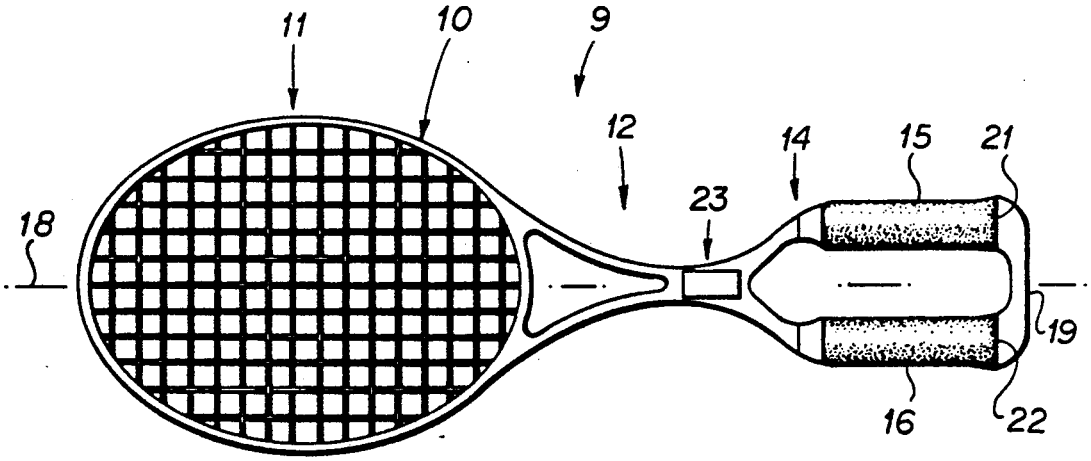
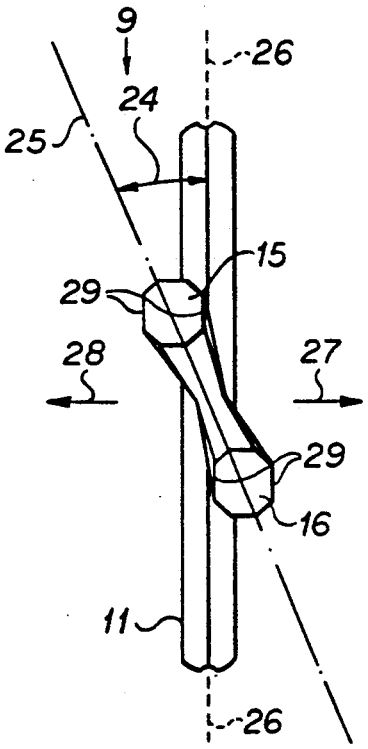
FIG 2A
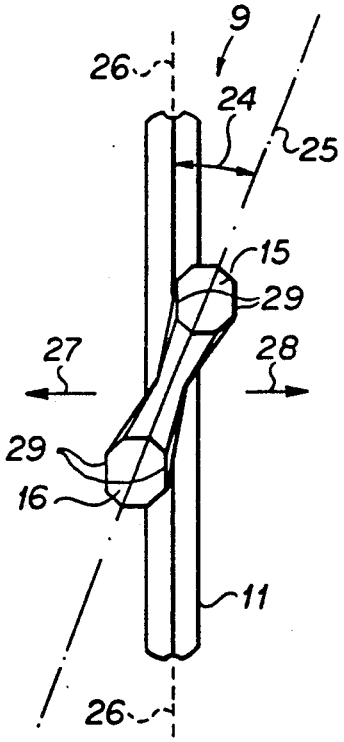
FIG 2B

TENNIS RACKET

FIELD OF THE INVENTION

The present invention relates to tennis rackets, and more particularly, to tennis rackets having dual-handled grips.

BACKGROUND OF THE INVENTION

In the game of tennis, of the major shots used in the game, the back hand shot generally is regarded as the most difficult shot to master. This is true mainly because the backhand shot creates the sensation that the back of the hand holding the racket is used to hit the shot, and people are not accustomed to using the backs of their hands for many functional purposes on or off the tennis court. They are, however, generally accustomed to using the front of their hands or their palms every day for a variety of purposes. Consequently, tennis players generally have a forehand shot that is much stronger than their backhand shot because that shot seems more natural, since it involves the front or palm of the hand.

To improve their backhands, many players use both hands, which, to some extent, creates the sensation of using the front, or palm, of the second, or opposite, hand. In addition, two hands allow the player to control the racket better, although at the sacrifice of the power and flexibility achievable with a one-handed backhand stroke. With conventional tennis rackets, a two-handed backhand requires that one hand be placed above the other on the single handle of the racket, a method of gripping the racket that limits the player's ability to snap or pronate the wrists through the ball during the shot to generate more power. To compensate for this limitation, two-handed players typically tend to involve their bodies, especially the left shoulders for right-handed players, to a large extent during the swing. Thus, they rotate their shoulders more on both the back-swing and the follow through, and they lean their left shoulders further forward into the shot, all in an effort to increase power. Such movement, especially the use of the left shoulder, can be tiring and often can cause soreness in that shoulder.

In addition, conventional single-handled rackets limit a player's ability to hit a two-handed backhand shot out in front of the body where an aggressive, offensive backhand is hit best. The two-handed grip used with a single-handled racket limits a player's reach because one hand has to grip the handle closer to the throat of the racket, and hence closer to the hitting area thereof. Consequently, on a two handed shot the ability of the player to reach and hit a tennis ball in front of the body is limited.

A two-handled tennis racket, which allows the player to hit a forehand ground-stroke from either side of the body is an alternative method for overcoming the inherent limitations of the backhand shot. U.S. Pat. No. 2,795,426 to Wood discloses a dual handled tennis racket comprising two handles aligned in a plane transverse to the plane of the racket head. With this racket, the right hand is used to hit a forehand from the right side of the body and the left hand is used to hit a forehand from the left side of the body. However, such a design tends to create some instability in the racket as a result of the lateral displacement of most of the weight of the racket a relatively large distance from the grip that is used for each shot.

U.S. Pat. No. 4,861,030 to Burt discloses a dual handled tennis racket comprising two handles aligned in a plane parallel or coincident with the plane of the racket head. This racket, like the racket of Wood, is designed for one of the grips to be grasped by the right hand for hitting a forehand on the right side of the body, and for the other grip to be grasped by the left hand for hitting a forehand on the left side of the body. However, such a design tends to limit a player's ability to hit the ball out in front of the body, due to the alignment of the handles with the racket head.

Conventional single-handled tennis rackets also limit a player's ability to hit many forehand shots, such as the forehand ground-stroke, the serve, and the forehand volley, out in front of the body. A tennis player can stroke the tennis ball earlier, with the player's weight behind the shot, and in a better position to see the opponent and the court when the tennis ball is hit out in front of the body. The alignment of the head of a conventional racket with the handle does not assist in stroking the tennis ball early.

Thus, a need exists for a racket designed for use by tennis players who use two-handed backhands that frees up the wrists to snap the racket through the ball, thereby increasing the potential for generating power, and reducing the amount of strain caused by the use of conventional single-handled rackets. A need also exists for a tennis racket that aids in stroking the tennis ball in front of the body for both forehand and backhand shots.

SUMMARY OF THE INVENTION

Briefly described, the present invention is an improved design for a two-handled tennis racket wherein the improvement comprises the rotation of the plane of the two handles so that the plane in which the handles lie and the plane in which the head of the racket lies form an angle within a range from 10 to 40 degrees. This design for a tennis racket improves the backhand and forehand ground-strokes as well as the serve and the forehand volley.

On the backhand stroke, which, with the racket of the invention, is preferably a two handed stroke the angle between the racket head and the grips allows a player to snap the wrists through the shot in a controlled manner and allows the player to hold the racket with the shoulders and arms positioned comfortably at the point of contact between the ball and the racket head out in front of the body, without the player's shoulders or arms being unduly strained when he hits the ball.

On the forehand ground-stroke, serve, and forehand volley, the angle between the racket head and the grips laterally displaces the head of the racket forward of the grip held by the player, which allows the player to hit the ball further in front of the body, yet without causing racket instability associated with the majority of the racket's weight being displaced a relatively large distance from the grip held by the player, as apparently is the case with the racket of Wood.

Accordingly, it is an object of the present invention improves a tennis player's ability to hit a backhand shot.

Another object of the present invention is to provide a tennis racket that reduces the effort involved and the strain incurred by the body during a two-handed backhand shot.

A further object of the present invention is to provide a tennis racket that increases the ability of a two-handed backhand player to snap the wrists through the ball during a backhand shot.

Yet another object of the present invention is to provide a tennis racket that increases a tennis player's ability to hit the ball further out in front of the body on the forehand ground stroke, serve, and forehand volley shots as well as on the backhand stroke.

Other objects, features and advantages of the present invention will become apparent from the following specification, when read in conjunction with the accompanying drawings.

BRIEF DESCRIPTION OF THE DRAWINGS

FIG. 1 is a plan view of the tennis racket of the present invention showing the two handled grip.

FIGS. 2A and 2B are end elevational views of, respectively, a left handed tennis racket embodying the principles of the invention and a right handed tennis racket embodying the principles of the invention, showing the angle between the handles and the racket head.

DETAILED DESCRIPTION

Figure 4:
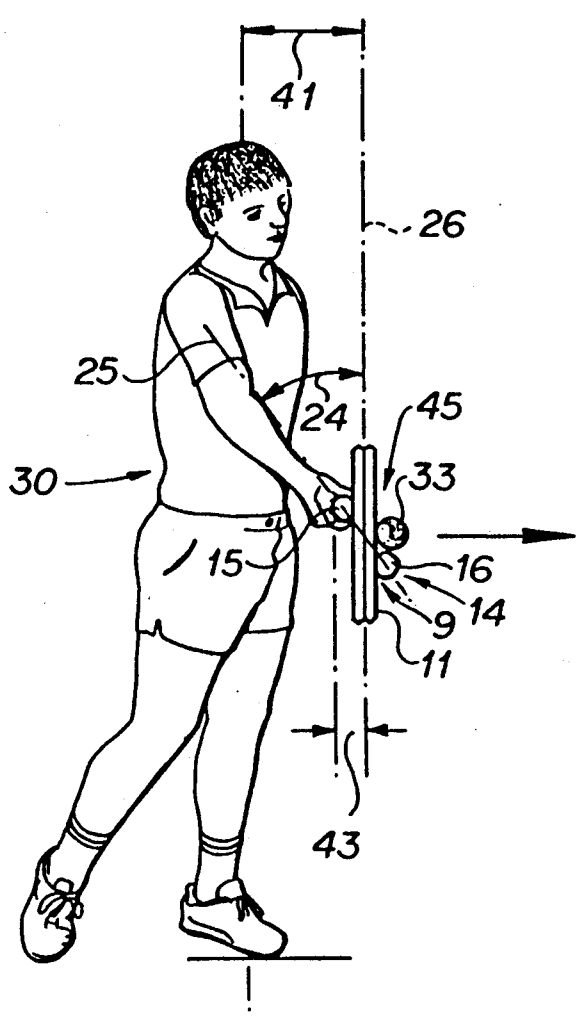
FIG. 4 is a view of the racket of the present invention held by a tennis player at the point of contact during a forehand ground-stroke shot.

Referring now in more detail to the drawings, in which like numerals represent like parts throughout the several views, FIG. 1 illustrates a tennis racket 9 that embodies principles of the present invention in a preferred form. The tennis racket 9 comprises a frame 10 defining a racket head 11, a throat 12, and a two-handled grip assembly 14 consisting of grips 15 and 16. The two handled grip assembly 14 include a rigid connector or U-shaped strut 19, which is mounted to the ends 21 and 22 of the grips 15 and 16, respectively. Strut 19 rigidly holds grips 15 and 16 in a spaced relationship thus imparting torsional rigidity to the two-handled grip assembly 14. Above grips 15 and 16, the two handled grip assembly 14 converges at junction 23 where it is secured to the throat 12.

FIGS. 2A and 2B show the angles 24 between the plane 25 in which the grip assembly 14 lies and the plane 26 in which the racket head 11 lies. FIG. 2A shows an end view of a tennis racket intended for use by a left handed tennis player, and FIG. 2B shows an end view of a tennis racket intended for use by a right handed tennis player. Also indicated in FIGS. 2A and 2B by arrows 27 and 28 are the directions in which a tennis player would hit a forehand and a backhand shot, respectively, in relation to the rackets 9 shown in the figures. It has been found in practice that the optimum angle for angle 24 falls within the range of ten to forty degrees as discussed hereinafter. The multi-sided grips 15 and 16 have sides 29 that are parallel to the racket head 11, which results in an alignment and orientation that tennis players are accustomed to with conventional single-handled rackets.

In order to hit an aggressive shot in tennis, it is generally desirable to hit the tennis ball out in front of the body. This allows the tennis player to hit the tennis ball earlier, with the player's weight behind the shot, and in a better position to see the opponent and the court. In addition, for beginner and intermediate tennis players it is also desirable to hit the tennis ball with the plane of the racket head aligned generally in a vertical position at the point of contact between the tennis ball and the racket head. A vertically aligned racket head increases the margin of error for the tennis player and the player's ability to control the shot. Furthermore, many tennis players prefer to hit the tennis ball with top spin, which allows them to hit the ball harder without sacrificing control. To generate top spin, a player swings the tennis racket in an upward swing arc path with the wrist pivoting or snapping forward in the direction of the follow through. The tennis racket of the present invention allows the tennis player to hit the tennis ball out in front of the body with the racket head generally having a vertical attitude, and in a manner that allows the wrist to snap forward on the follow through.

Figure 3:
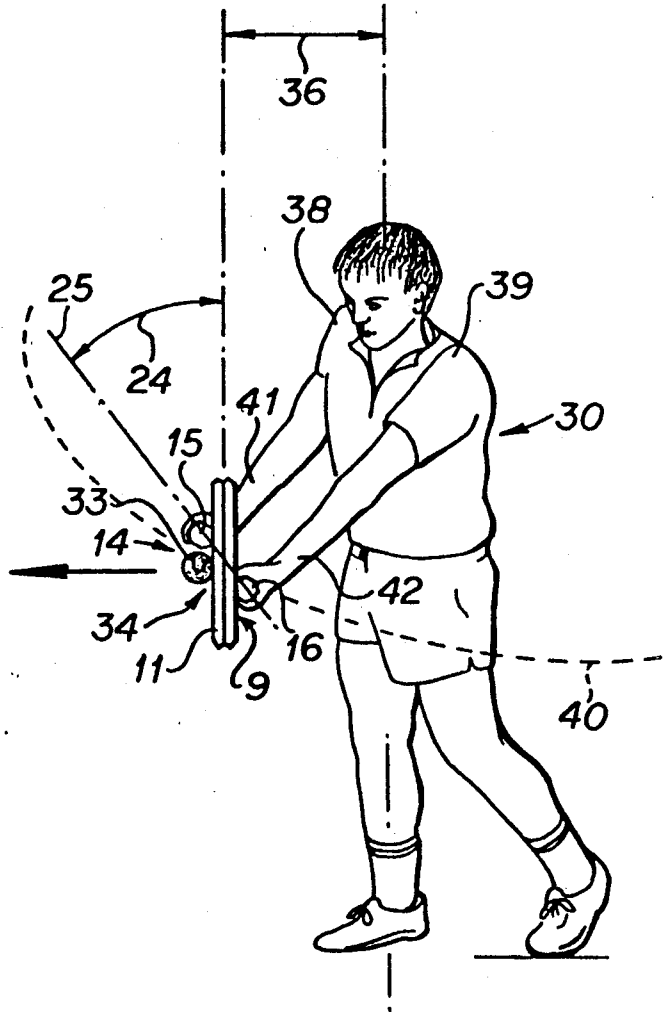
FIG. 3 is a view of the racket of the present invention held by a tennis player at the point of contact during a backhand ground-stroke shot.

FIG. 3 illustrates a right handed tennis player 30 hitting a backhand ground stroke with the tennis racket 9 of the present invention. The tennis player 30 is shown hitting the tennis ball 33 at a point of contact 34 that is out in front of the player's body. This distance in front of the player's body is depicted by arrow 36, and will vary according to the player's style of play, aggressive players preferring to hit the ball very early. The racket head 11 at the point of contact 34 is shown generally in a vertical position. The angle 24 between the grip assembly 14 and racket head 11 places the plane of the grip assembly 14 in a position that is generally parallel to the plane of the shoulders 38,39 of the player 30. This arrangement allows the shoulders to remain in a comfortable position at the point of contact with the leading shoulder 38 only slightly raised in relationship to the trailing shoulder 39. If the angle 24 between the grip assembly 14 and the racket head 11 was less than ten degrees, the player would be required to make an adjustment with the shoulders 38,39 and raise the leading shoulder 38 and lower the trailing shoulder 39 so that the shoulders are repositioned from a comfortable slightly inclined position to an uncomfortable more vertical position. With such a posture, the shoulders are in a strained position when the racket is at the point of contact 34, which makes hitting the tennis ball in front of the body uncomfortable and difficult. If the angle 24 between the grip assembly 14 and the racket head 11 was greater than forty degrees, the player would have to move the point of contact 34 close to the side of his body and further away from the direction in which the ball is to be hit in order to keep the racket head 11 aligned vertically, an adjustment which negates the advantages of hitting the ball early. With the grip assembly 14 aligned with respect to the racket head 11 at an angle within the range of ten to forty degrees, the player 30 can stroke the ball aggressively out in front of the body with his shoulders 38,39 positioned comfortably for minimum strain and the racket head 11 aligned vertically for maximum control.

The alignment of the grip assembly 14 angled from the racket head 11 also positions the grips 15 and 16 in a position that allows the player 30 to snap or pronate the wrists 41,42 through the point of contact 34 in a manner allowing the wrists to work together, thereby accelerating the head of the racket 11 through the ball in a controlled manner. The wrists 41,42 can move in the same upward direction along the swing path 40, which increases the player's ability to control the racket head and still generate power. If the angle 24 between the grip assembly 14 and the racket head 11 was greater than forty degrees, in order to snap the wrists 41,42 through the point of contact 34, the leading wrist 41 would have to pull on grip 15 while the trailing wrist 42 pushed on grip 16. This counteraction between the wrists 41,42 increases the difficulty of controlling the racket head 11 to keep it aligned vertically through the point of contact 34, which greatly increases the difficulty for the average tennis player in hitting the ball into the opponent's court. If the angle 24 between the plane of the grip assembly 14 and the plane of the racket head 11 were less than ten degrees, the upper grip 15 would be positioned closer to the lower wrist 42, which could cause the upper grip 15 to interfere with the player's lower wrist 42 and, consequently, make it more difficult, and sometimes more uncomfortable, to snap the wrists. Thus, a range from ten to forty degrees for angle 24 allows the player to snap the wrists 41,42 in a comfortable, uniform manner, resulting in increased power and control.

Therefore, in the design of the tennis racket of the present invention, it has been found that as the angle 24 between the planes of the grip assembly 14 and the racket head 11 is greater than forty degrees, the flexibility of the wrists and the player's ability to move the wrists in a uniform manner through the point of contact is reduced, resulting in loss of power and control. When the angle 24 between the plane of the grip assembly 14 and the plane of the racket head 11 is less than ten degrees, in order to hit an aggressive backhand shot out in front of the player's body, the player has to adjust the shoulders with the leading shoulder raised much above the player's trailing shoulder, which is uncomfortable, unnatural, and can cause soreness in the shoulders. Thus, a range from ten degrees to forty degrees has been found to work unexpectedly well in practice, allowing the tennis player to keep the shoulders aligned more horizontally and thus, more comfortably, and to allow the player to move the wrists in a uniform manner through the point of contact, while aggressively hitting the tennis ball out in front of the body with the head of the racket aligned generally vertically.

FIG. 4 illustrates a right handed tennis player 30 hitting a forehand ground-stroke with the racket 9 of the present invention. As with the backhand, when hitting a forehand shot it is also desirable to hit the tennis ball out in front of the body. The point of contact 45 of the tennis ball 33 with the racket head 11 is illustrated in FIG. 4 at a point out in front of the body 30 represented by distance 41. With the forehand ground-stroke, the angle 24 between the grip assembly 14 and the racket head 11 causes the upper grip 15, the grip that is used when hitting a one handed forehand shot, to be offset or laterally displaced behind from the racket head 11 a relatively short distance, as illustrated by arrow 43. This displacement moves the racket head 11 in front of the grip 15 towards the opponent's court and allows the tennis player 30 to hit the tennis ball 33 further out in front of the body. If the angle 24 between the grip assembly 14 and the racket head 11 were greater than forty degrees, the distance 43 that grip 15 would be displaced from the racket head 11 would be at a maximum, and, with such an arrangement, the racket would lose stability. With angle 24 at these larger angles, grip 15 is subject to more torque as a result of the increase in distance between the grip 15 and the rest of the racket 9, particularly the racket head 11 and the opposite, lower grip 16. Consequently, while it is desirable to displace grip 15 from the racket head 11, such displacement is limited by the increased instability associated with such an increase in displacement. In practice, it has been found that a range of angles from ten degrees to forty degrees for the angle 24 between the grip assembly 14 and the racket head 11 is optimum for displacing the racket head 11 in front of the grip 15 and, consequently, greatly improving a player's ability to hit the tennis ball early, without making the racket too unstable for the average tennis player.

With both the serve and the forehand volley, displacement of the racket head 11 in front of the grip 15 also serves to move the point of contact in front of the body. This forward displacement of the racket head 11 has the same beneficial effect for these shots as it does for the forehand ground-stroke. In addition, if the angle 24 between the grip assembly 14 and the racket head 11 was greater than forty degrees, the stability problems encountered on the forehand ground-stroke would also be encountered on the serve and the forehand volley. Hence, the range of angles from ten to forty degrees found to be optimum for the forehand ground-stroke is also optimum for the serve and the forehand volley.

Accordingly, it can be seen that the tennis racket of the invention makes possible greatly increased power, control and stability of the tennis racket while reducing the effort required to hit most shots, especially the backhand shot, which consequently is a marked improvement over the prior art.

The principles of the invention have been illustrated in a tennis racket, but are equally applicable to other sports involving the use of a racket to strike a ball.

The features and principles of the present invention have been illustrated in the foregoing description of a preferred embodiment thereof. It will be apparent to those skilled in the art that numerous changes or modifications may be made without departure from the spirit and scope of the invention as claimed hereinafter.

I claim:

1. An improved tennis racket comprising a racket head (11) for supporting a network of strings lying in a first common plane (26), an elongated throat (12) extending from the racket head, and two separate elongated handles (15,16) each having an elongated central axis and adapted to be separately grasped and spaced side-by-side with respect to each other and mounted to the distal end of the throat for gripping the tennis racket, wherein the improvement comprises:

the central axis of each of the two handles being oriented to lie in a second common plane (25), and the first common plane being set angularly apart from the second common plane by an angle of 10 to 40 degrees, the two handles being rigidly mounted to the throat so that movement of either handle is directly imparted to the racket head.

2. The tennis racket of claim 1 wherein the handles have substantially polygonally shaped cross sections and flat outer surfaces having opposed surfaces extending parallel to said first common plane.

3. The tennis racket of claim 1 and further comprising a rigid connector mounted to the distal ends of the handles for rigidly securing the handles apart in a spaced relationship.

4. A racket comprising a frame defining a racket head, an intermediate elongated throat extending from the racket head, and first and second separate elongated handles each having an elongated central axis and adapted to be separately grasped and spaced side-by-side with respect to each other and rigidly mounted to the throat at the distal end of the throat wherein the central axis of the first and second handles lie in a first plane, the racket head defines and lies in a second plane, and said first plane being oriented at an angle to said second plane, said angle being in the range of 10 degrees to 40 degrees.

5. A racket as claimed in claim 4 wherein said handles each have substantially polygonally shaped cross sections and flat outer surfaces having opposed flat surfaces extending parallel to said racket head for orienting said racket head at a desired attitude.

* * * * *